US007905117B2

(12) United States Patent
Kronback

(10) Patent No.: US 7,905,117 B2
(45) Date of Patent: Mar. 15, 2011

(54) PROCESS FOR MANUFACTURING A SHAPING CAMISOLE AND GARMENT MADE THEREBY

(75) Inventor: Bonnie Kronback, Winston-Salem, NC (US)

(73) Assignee: Holt Hosiery Mills, Inc., Burlington, NC (US)

( * ) Notice: Subject to any disclaimer, the term of this patent is extended or adjusted under 35 U.S.C. 154(b) by 1179 days.

(21) Appl. No.: 11/527,977

(22) Filed: Sep. 28, 2006

(65) Prior Publication Data

US 2008/0078208 A1 Apr. 3, 2008

(51) Int. Cl.
*D04B 11/00* (2006.01)

(52) U.S. Cl. ..... 66/176

(58) Field of Classification Search ..... 66/172 E, 66/195, 171, 175, 176; 450/30–34
See application file for complete search history.

(56) References Cited

U.S. PATENT DOCUMENTS

| | | | | | |
|---|---|---|---|---|---|
| 1,666,421 | A * | 4/1928 | Krause | 450/4 |
| 1,994,990 | A * | 3/1935 | Flesh | 450/33 |
| 2,009,620 | A * | 7/1935 | Jackson | 450/28 |
| 2,115,146 | A * | 4/1938 | Kops | 450/9 |
| 2,438,062 | A * | 3/1948 | Licht | 450/30 |
| 4,372,320 | A * | 2/1983 | Silber | 450/31 |
| 4,398,538 | A * | 8/1983 | Johnson | 450/8 |
| 4,440,174 | A * | 4/1984 | Cordova | 450/31 |
| 4,564,015 | A * | 1/1986 | Friedman | 450/31 |
| 4,590,945 | A | 5/1986 | Fiel | 128/455 |
| 4,798,557 | A * | 1/1989 | Scott | 450/31 |
| 5,033,986 | A * | 7/1991 | Feigenbaum et al. | 450/30 |
| 5,359,732 | A * | 11/1994 | Waldman et al. | 2/67 |
| 5,737,773 | A | 4/1998 | Dicker et al. | 2/69 |
| 5,907,872 | A | 6/1999 | Alberts et al. | 2/243.1 |
| 5,953,754 | A | 9/1999 | Rosch et al. | 2/73 |
| 6,061,832 | A | 5/2000 | Morrison, Jr. | 2/78.1 |
| 6,113,460 | A * | 9/2000 | McKeown | 450/31 |
| 6,336,840 | B2 * | 1/2002 | Heroff | 450/30 |
| 6,443,805 | B1 * | 9/2002 | Kirkwood | 450/31 |
| 6,530,820 | B1 | 3/2003 | Katze et al. | 450/7 |
| 6,668,598 | B2 | 12/2003 | Miyake et al. | 66/195 |
| 6,745,601 | B2 | 6/2004 | Pierelli | 66/195 |
| 6,846,217 | B1 * | 1/2005 | Struble et al. | 450/31 |
| 6,886,369 | B2 | 5/2005 | Fukaro et al. | 66/202 |
| 7,416,470 | B2 * | 8/2008 | Zarabi | 450/22 |
| 7,488,234 | B2 * | 2/2009 | Rothman et al. | 450/36 |
| 7,631,521 | B2 * | 12/2009 | Oya | 66/172 E |
| 2005/0115282 | A1 * | 6/2005 | Starbuck | 66/176 |

* cited by examiner

*Primary Examiner* — Danny Worrell
(74) *Attorney, Agent, or Firm* — MacCord Mason PLLC

(57) ABSTRACT

A method for manufacturing a shaping camisole and the article produced therefrom having an outer decorative portion and an inner knit tube made with elastomeric yarn to provide midsection support.

12 Claims, 3 Drawing Sheets

PROCESS FOR MANUFACTURING A SHAPING CAMISOLE AND GARMENT MADE THEREBY

FIELD OF THE INVENTION

The present invention relates to a to a process for the manufacture of a shaping camisole garment such as a short shirt, negligee jacket or a short sleeveless undergarment all for women and to a process for the manufacture of camisole type garments.

BACKGROUND OF THE INVENTION

Manufacturers constantly seek new, cost-effective, relatively inexpensive processes for manufacturing clothing for everyday use. Moreover, consumers are interested in active wear or light support garments that are comfortable and relatively inexpensive.

Previous and current methods for producing active wear or light support garments for women similar to those contemplated by the present invention usually require pieces of fabric of varying densities and support characteristics to be cut into specific patterns in a multi-step process for assembly into articles of clothing. The resulting garment usually resembles a girdle or some other undergarment without any substantial fashion value as an outer garment because of the numerous seams and design curvatures required to be employed. The manufacturing process is also labor intensive and relatively slow because of the numerous sewing stages required. From the foregoing discussion, it will be apparent that there is a need to develop a manufacturing process and a product made by that process that will enable the manufacture of a cost-effective, relatively inexpensive, high manufacturing efficiency body shaping garment having desirable fashion characteristics. It is to that objective that the present invention is directed.

SUMMARY AND OBJECTIVES OF THE INVENTION

One aspect of the present invention is a process for the manufacture of a camisole garment to be worn about the upper body comprising the steps of providing an inner body portion having front and back fabric portions each having first and second vertical edges formed from 40 denier nylon and 40 denier spandex yarn and having a minimum stretch characteristic of 80%, shaping each of the inner body formed front and back fabric portions to define an arm-encircling opening, a top edge and a strap formed thereby, joining the inner body front and back portions along abutting vertical edges to form the inner body portion, providing an outer body portion having front and back portions to achieve a desired appearance, shaping each of the outer body formed front and back fabric portions to define an arm-encircling opening, a top edge and a strap formed thereby, joining the outer body front and back portions along abutting vertical edges to form the outer body portion, and joining the inner body portion to the outer body portion to provide one double layer shaping camisole.

Another feature of the present invention is to provide a shaping camisole formed of two (2) body-encircling portions made on a multi-needle knitting machine each having arm-receiving openings, a top edge and straps formed thereby. The camisole has an inner body-encircling portion having front and back portions formed from nylon and spandex yarns combined to be knit on each yarn feed to yield a fabric with a fiber content of 80% nylon and 20% spandex and a stretch characteristic of at least 80%, the front and back portions being joined by two side stretchable seams and having a hem, and an outer body portion having front and back portions to achieve a desired appearance, the inner body portion joined to the outer body portion along the top edges and the formed straps.

From the foregoing summary, it can be seen that the primary objective of the present invention is to provide a process for making and a garment made by the process for shaping a wearer's body while providing a fashionable appearance which is made as two separate garments (an inner body portion and an outer body portion).

The inner body portion is designed to provide shaping benefits for the wearer and is made from a fabric that has compression characteristics and is designed to fit snugly to the body and tuck into the wear's pants or skirt. This provides the shaping benefit and is not visible when observing the wearer because of the outer body portion design.

The outer body portion of the camisole is designed to meet the fashion needs of the wearer. It can be constructed of many types of fabric and in many different configurations. The fabric can be any warp knit solid fabric or any Raschel closed or open lace fabric. The outer body portion can be sleeved, sleeveless, tank top or strapless and completely covers the inner body portion. This makes it possible for the wearer to have the shaping benefits of the inner body portion without disclosing that she is wearing a double layered garment.

Thus there has been outlined the more important features of the invention in order that the detailed description that follows may be better understood and in order that the present contribution to the art may be better appreciated. There are, of course, additional features of the invention that will be described hereinafter and which will form the subject matter of the claims appended hereto. In that respect, before explaining at lest one embodiment of the invention in detail, it is to be understood that the invention is not limited in its arrangement of the components set forth in the following description and illustrated in the drawings. The invention is capable of other embodiments and of being practiced and carried out in various ways.

It is also understood that the phraseology and terminology employed herein are for the purpose of description and should not be regarded as limiting in any respect. Those skilled in the art will appreciate that the concept upon which this disclosure is based may readily be utilized as a basis for designing other structures, methods and systems for carrying out the several purposes of this development. It is important that the claims be regarded as including such equivalent methods and products resulting therefrom that do not depart from the spirit and scope of the present invention. The application is neither intended to define the invention, which is measured by its claims, nor to limit its scope in any way.

Thus, the objects of the invention set forth above, along with the various features of novelty which characterize the invention, are noted with particularity in the claims annexed to and forming a part of this disclosure. For a better understanding of the invention, its operating advantages and the specific results obtained by its use, reference should be made to the following detailed specification taken in conjunction with accompanying drawings wherein like characters of reference designate like parts throughout the several views.

The drawings are included to provide a further understanding of the invention and are incorporated in and constitute a part of this specification. They illustrate embodiments of the invention and, together with their description, serve to explain the principles of the invention.

DETAILED DESCRIPTION OF THE PREFERRED EMBODIMENTS

Figure 1:
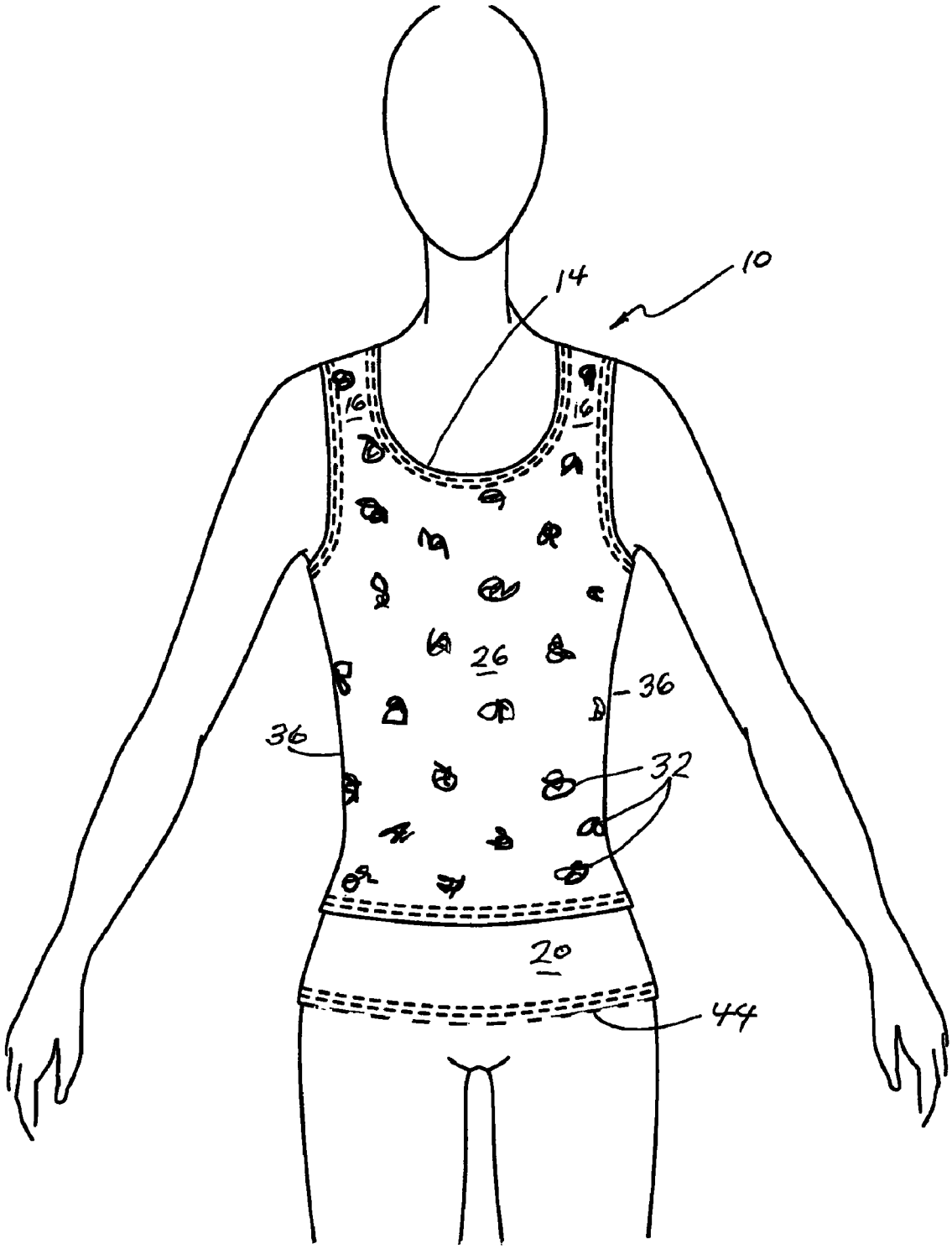
FIG. 1 is a front elevational view of the shaping camisole garment forming a part of the present invention and formed by the use of the process also constituting a part of the present invention.
Figure 2:
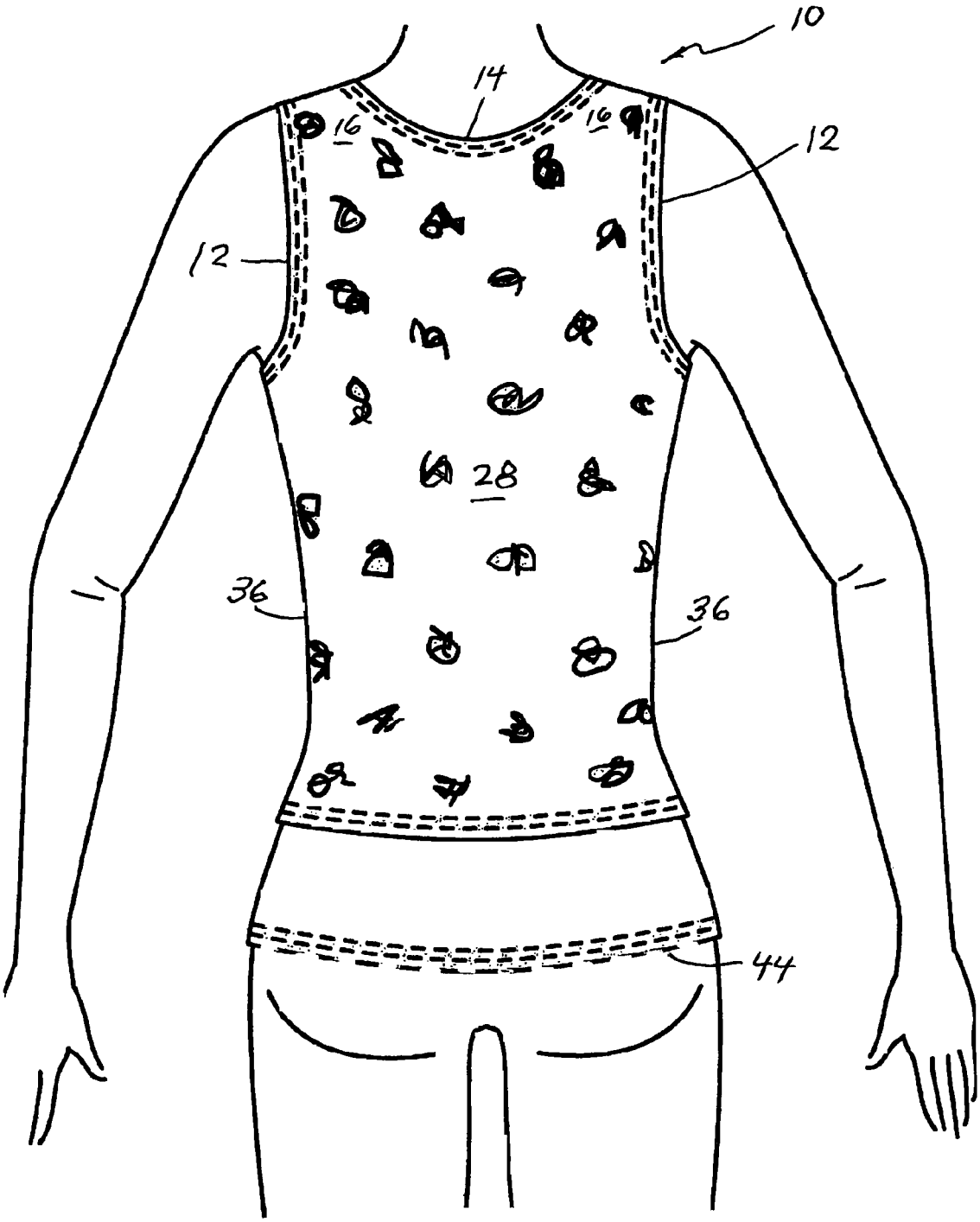
FIG. 2 is a back view of the shaping camisole shown in FIG. 1.
Figure 3:
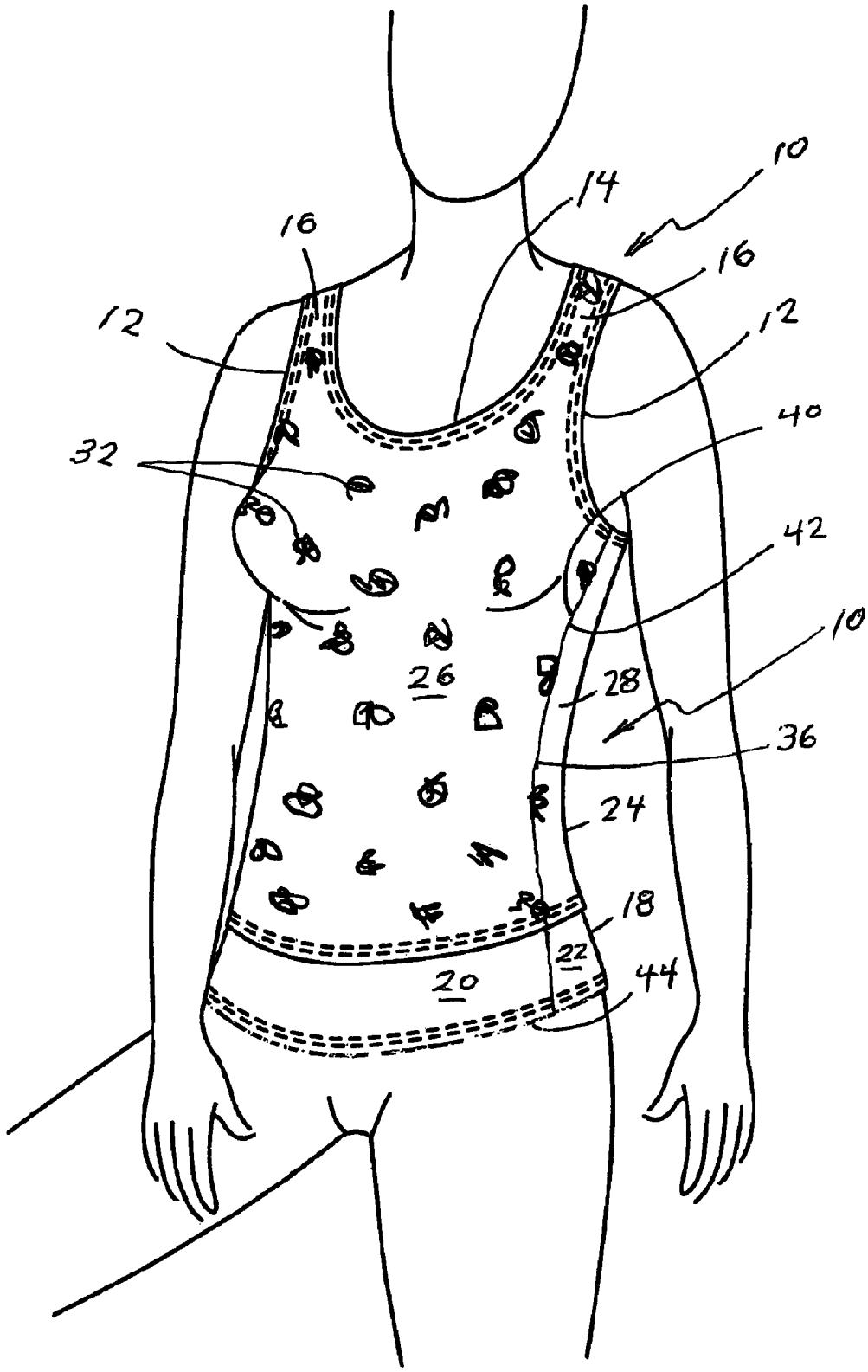
FIG. 3 is a perspective view of the shaping camisole shown in FIGS. 1 and 2.

Referring now to the drawings and particularly to FIG. 1, a shaping camisole garment ("camisole") shown generally as 10 has arm-receiving openings 12, a top edge 14 and straps 16 defined therein. Camisole 10 is formed of an inner body portion 18 and an outer body portion 24 as shown in FIG. 3.

Inner body portion 18 is designed to provide shaping benefits for the wearer, being made from a fabric that has compressive characteristics and designed to fit snuggly to the body and tuck into the wear's pants or skirt 19. Thus outer body portion 24 completely covers inner body portion 18.

Inner body portion 18 has front and back portions 20, 22 formed from nylon and spandex yarns. These yarns are combined to be knit on each yarn feed of a multi-needle knitting machine such as a tricot warp knit machine to yield a fabric with a fiber content of 80% nylon and 20% spandex having a minimum stretch characteristic of at least 80%. This means that a measured length of unstretched fabric, for example 5 inches, must be stretchable to a length of at least 9 inches and must return to its original length when the pull force is released. In order to consistently attain these stretch characteristics, the nylon and spandex yarns are maintained at constant tension levels during knitting by the use of yarn tension devices.

Outer body portion 24 has front and back portions 26, 28 formed from less compressive and preferably decorative fabric. It can be any warp knit solid fabric or any Raschel type closed or open lace fabric. Outer body portion 24 can be sleeved, sleeveless, tank top or strapless.

Front and back inner body portions 20, 22 have vertical edges positioned in FIG. 3 under the front and back outer body portions adjacent vertical edges 40, 42. These seams are preferably sewn using a four needle flat seam which provides maximum stretch, maximum comfort for the wearer and the least visibility of the seam when viewed from the outside during wearing. Since this seam is flat in construction, it does not cut into the wear's skin during body stretching and twisting. It is also invisible under clothing (and similarly under outer body portion 24), since there is no thick area or bulge to show through and be seen from the outside.

Inner body portion 18 is preferably secured to outer body portion 24 by a four needle flatseam positioned along top edge 14 and arm-receiving openings 12.

Fabric is produced and provided to the cutting and sewing operation on rolls. These rolls are spread in layers on a cutting table. A predetermined pattern is used to cut front inner body and back inner body portions 20, 22 of inner body portion 18 and front outer body and back outer body portions 26, 28 of outer body portion 24. The patterns are placed on the layers of fabric and the fabric layers are cut around each pattern. All necessary cut pieces are now available to produce inner and outer body portions 18, 24.

To fully complete outer body portion 24, needed lace or trim accessories are attached before inner and outer body portions 18, 24 are joined.

A hem 44 is formed along he bottom edge of inner body portion 18 using a two needle cover stitch which holds he end of the cut fabric in place and eliminates the rolling that can occur if more traditional overhead seams are used to lock the fabric at the bottom of the garment.

From the preceding description, it can be seen that a shaping camisole and process for making have been provided that will meet all of the advantages of prior art devices and offer additional advantages not heretofore achievable. With respect to the foregoing invention, the optimum dimensional relationship to the parts of the invention including variations in size, materials, shape, form, function, and manner of operation, use and assembly are deemed readily apparent to those skilled in the art, and all equivalent relationships illustrated in the drawings and described in the specification are intended to be encompassed herein.

The foregoing is considered as illustrative only of the principles of the invention. Numerous modifications and changes will readily occur to those skilled in the art, and it is not desired to limit the invention to the exact construction and operation shown and described. All suitable modifications and equivalents that fall within the scope of the appended claims are deemed within the present inventive concept.

What is claimed is:

1. A shaping camisole formed of two body encircling portions made on a multi-needle knitting machine each having arm-receiving openings, a top edge and straps formed thereby, the camisole comprising: an inner body portion having front and back portions formed from nylon and spandex yarns combined to be knit on each feed to yield a fabric with a fiber content of 80% nylon and 20% spandex and a stretch characteristic of at least eighty percent (80%), the front and back portions being joined by two side stretchable seams and having a hem that terminates above the groin of a wearer; and an outer body portion having front and back portions formed to achieve a desired appearance, the inner body portion joined to the outer body portion along the top edges and the formed straps, wherein the inner body portion has a greater vertical length than the outer body portion.

2. The camisole as claimed in claim 1 wherein the stretch characteristic of at least eighty percent (80%) is achieved by maintaining the nylon and spandex yarns at consistent tension levels on all feeds during knitting.

3. The camisole as claimed in claim 1 wherein the outer body portion is formed of warp knit fabric.

4. The camisole as claimed in claim 1 wherein the outer body portion has trim material selectively positioned and secured thereto.

5. The camisole as claimed in claim 1 wherein the outer body portion has a sleeve attached to an arm-receiving opening.

6. The camisole as claimed in claim 1 wherein the inner body portion is not visible where the camisole is worn by the wearer.

7. The camisole as claimed in claim 3 wherein the stretch characteristic of at least eighty percent (80%) is achieved by maintaining the nylon and spandex yarns at consistent tension levels on all feeds during knitting.

8. The camisole as claimed in claim 7 wherein the outer body portion is formed of warp knit fabric.

9. The camisole as claimed in claim 8 wherein the outer body portion has trim material selectively positioned and secured thereto.

10. The camisole as claimed in claim 9 wherein the outer body portion has a sleeve attached to an arm-receiving opening.

11. The camisole as claimed in claim 3 wherein the outer body portion is formed of warp knit fabric and has trim material selectively positioned and secured thereto.

12. The camisole as claimed in claim 1 wherein the inner body tucks into a wearer's pants or skirt.

* * * * *